US010760581B2

(12) United States Patent
Kim

(10) Patent No.: US 10,760,581 B2
(45) Date of Patent: Sep. 1, 2020

(54) BLOWOFF VALVE USING DIFFERENTIAL PRESSURE OF AIR

(71) Applicant: Minsoo Kim, Daejeon (KR)

(72) Inventor: Minsoo Kim, Daejeon (KR)

( * ) Notice: Subject to any disclaimer, the term of this patent is extended or adjusted under 35 U.S.C. 154(b) by 0 days.

(21) Appl. No.: 16/313,445

(22) PCT Filed: Jun. 26, 2017

(86) PCT No.: PCT/KR2017/006684
§ 371 (c)(1),
(2) Date: Dec. 26, 2018

(87) PCT Pub. No.: WO2018/004209
PCT Pub. Date: Jan. 4, 2018

(65) Prior Publication Data

US 2019/0162198 A1 May 30, 2019

(30) Foreign Application Priority Data

Jun. 28, 2016 (KR) ..... 10-2016-0081114

(51) Int. Cl.
*F04D 27/02* (2006.01)
*F04D 29/00* (2006.01)
*F04D 29/40* (2006.01)

(52) U.S. Cl.
CPC ..... *F04D 27/0215* (2013.01); *F04D 27/02* (2013.01); *F04D 29/00* (2013.01); *F04D 29/002* (2013.01); *F04D 29/40* (2013.01); *F04D 29/403* (2013.01); *F05D 2210/12* (2013.01)

(58) Field of Classification Search
USPC ..... 137/469
See application file for complete search history.

(56) References Cited

U.S. PATENT DOCUMENTS

| | | | | |
|---|---|---|---|---|
| 3,255,773 | A * | 6/1966 | McQueen | F16K 31/34 137/414 |
| 3,859,484 | A | 1/1975 | Nelson | |
| 7,647,941 | B2 * | 1/2010 | Onoe | B65D 88/703 137/489 |
| 2005/0167624 | A1 | 8/2005 | Perez | |
| 2014/0261782 | A1 * | 9/2014 | Vu | F16K 17/196 137/469 |

FOREIGN PATENT DOCUMENTS

| | | | |
|---|---|---|---|
| CN | 202215498 | U | 5/2012 |
| JP | 02-090467 | U | 7/1990 |
| JP | 2007-519873 | A | 7/2007 |
| JP | 2012-073767 | A | 4/2012 |
| KR | 10-0861248 | B1 | 10/2008 |
| KR | 10-2013-0024342 | A | 3/2013 |
| KR | 10-1295734 | B1 | 8/2013 |

OTHER PUBLICATIONS

Jinzhe et al., CN 202215498, 2012, Espacenet Translation (Year: 2012).*

* cited by examiner

*Primary Examiner* — Daphne M Barry
(74) *Attorney, Agent, or Firm* — Rabin & Berdo, P.C.

(57) ABSTRACT

The present invention relates to a BOV valve using differential pressure of air and, more particularly, to a BOV valve that is operated using differential pressure of air.

1 Claim, 8 Drawing Sheets

BLOWOFF VALVE USING DIFFERENTIAL PRESSURE OF AIR

TECHNICAL FIELD

The present invention relates to a BOV valve using differential pressure of air and, more particularly, to a BOV valve that is operated using differential pressure of air.

BACKGROUND ART

A turbo blower is a machine, which suctions and blows external air by rotating an impeller at a high speed using torque of a motor, and is used for transfer of powder or aeration at a sewage plant etc.

According to such a turbo blower, rotation of the motor does not reach a steady state in the early operation and the pressure of the blown air is correspondingly low, so it is difficult to achieve the original objects such as aeration when using the turbo blower at a sewage plant.

Accordingly, the motor is made to quickly reach the steady state by discharging the blown air to the atmosphere until the torque of the motor reaches the steady state, and then, the air is blown to the originally desired location.

For this purpose, a butterfly valve is used in the related art, in which an actuator operates a valve using high-pressure air produced by a compressor, thereby discharging air blown in the early operation of a turbo blower, and then the air is blown to the originally desired location when a steady state is entered.

However, in this case, a lot of electricity is wasted because a separate compressor should be operated to produce high-pressure compressed air, and air may not be discharged due to some trouble with the compressor, which may cause a problem with the operation of the turbo blower. Further, a tube connecting the compressor and the butterfly valve to each other occupies a space, so it is troublesome. Further, a lot of troubles are caused by the length of the tube and a separate power for operating the compressor.

A blow-off valve has been developed to solve these problems.

The blow-off valve prevents a compression part of a turbo blower entering surge by discharging pressurized air remaining in a discharge pipe to the outside when the operation of the turbo blower is not in a steady state such as the early stage or stop of operation.

A conventional blow-off valve has been disclosed in Korean Patent No. 861248. This blow-off valve is configured to be operated by pressurized air from a turbo blower.

The blow-off valve requires a spool valve that is moved up and down to blow air. The spool valve includes a vertical shaft (stem) and a valve seat (second spool) that opens/closes an air channel at a lower end.

A rubber diaphragm is disposed over the shaft, so the diaphragm is repeatedly compressed to a valve cover (head) and returned to the initial position in the process of blowing air.

However, the structure of the blow-off valve is complicated, so the process of manufacturing and providing a complete product is complicated and the manufacturing process takes a lot of time.

Therefore, a BOV valve that uses differential pressure and can be accurately operated even without a complicated structure has been proposed.

CITATION LIST

Patent Literature

[Patent Literature 1]
Korean Patent No. 10-0861248

DISCLOSURE

Technical Problem

Therefore, the present invention has been made in an effort to solve the problems in the related art and an object of the present invention is to provide a BOV valve that is operated using differential pressure of air.

Another object of the present invention is to increase the response speed of a diaphragm by forming a plurality of air inflow expansion grooves and air inflow induction grooves in a BOV bonnet.

Technical Solution

According to one aspect of the present invention so as to accomplish these objects, there is provided to a BOV valve using differential pressure of air, the BOV valve including:

a BOV base (100) having a flange (110) on the top, having an internal space, having a blowing port (130) connected with an outlet of a turbo blower, and having a discharge port (120) for discharging air flowing inside through the blowing port;

a diaphragm (200) having a side being in contact with the flange, having a slope (210) inside, including a spring-coupling plate (230) formed on a side of the slope, and having a spring-coupling portion (220) at the center;

an air hole (300) formed at a side of the slope of the diaphragm to function as an air channel;

a spring (400) coupled to a spring-coupling portion formed at the center of the diaphragm;

a BOV bonnet (500) having a bonnet flange (510) formed on the edge to be coupled to the flange of the BOV base with the diaphragm therebetween, a bonnet protrusion (520) formed inside the bonnet flange and protruding upward such that the bottom is higher than the bottom of the bonnet flange, and a center hole (530) formed at the center of the bonnet protrusion;

a pipe (600) having a first end coupled to the center hole and a second end coupled to a solenoid valve; and the solenoid valve (700) coupled to the pipe.

Advantageous Effects

According to the present invention, a BOV valve that is operated using differential pressure of air can be accurately operated and includes a BOV base manufactured by molding, so the manufacturing process and assembly process can be simplified.

Further, it is possible to increase the response speed of a diaphragm by forming a plurality of air inflow expansion grooves and air inflow induction grooves in a BOV bonnet.

BRIEF DESCRIPTION OF DRAWINGS

The above and other objects, features and advantages of the present invention will be more apparent from the following detailed description taken in conjunction with the accompanying drawings, in which.

REFERENCE SIGNS LIST

Figure 1:
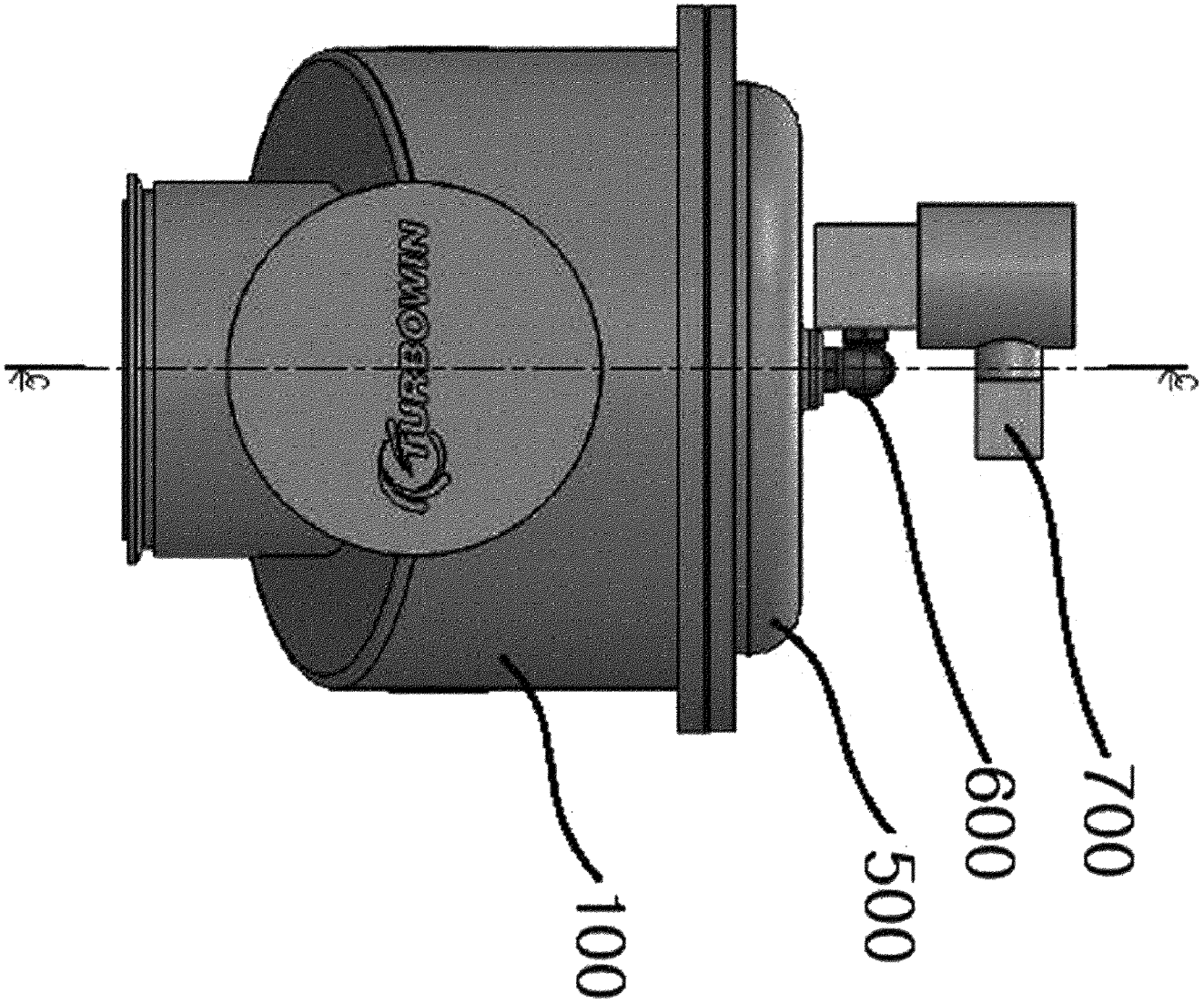
FIG. 1 is a front view of a BOV valve using differential pressure of air according to an embodiment of the present invention.

100: BOV base
200: diaphragm
300: air hole
400: spring
500: BOV bonnet
600: pipe
700: solenoid valve

BEST MODE

Mode for Invention

Hereafter, a BOV valve using differential pressure of air according to the present invention is described in detail with reference to embodiments.

Figure 2:
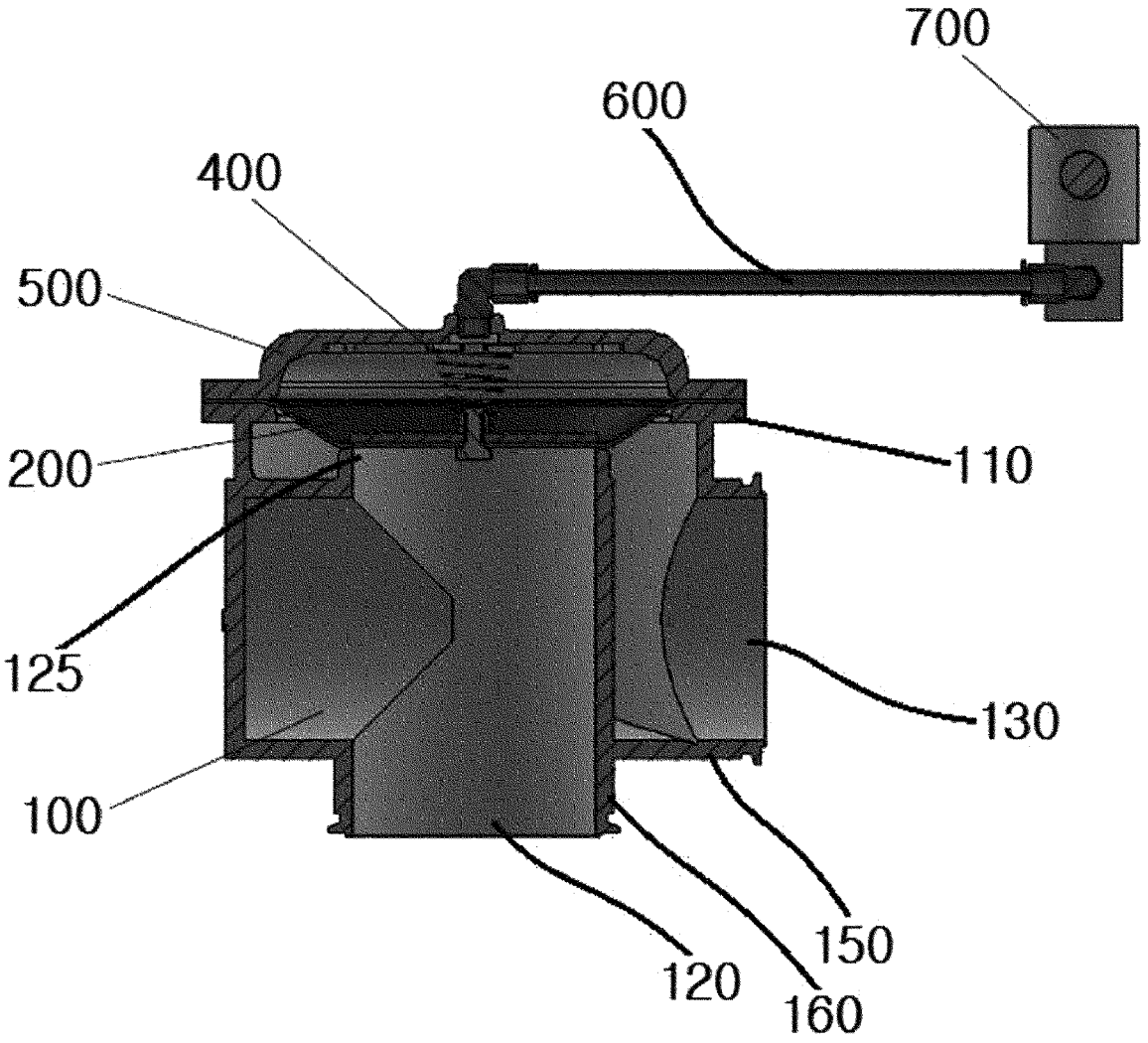
FIG. 2 is a cross-sectional view taken along line C-C.

FIG. 1 is a front view of a BOV valve using differential pressure of air according to an embodiment of the present invention, and FIG. 2 is a cross-sectional view taken along line C-C.

Figure 3:
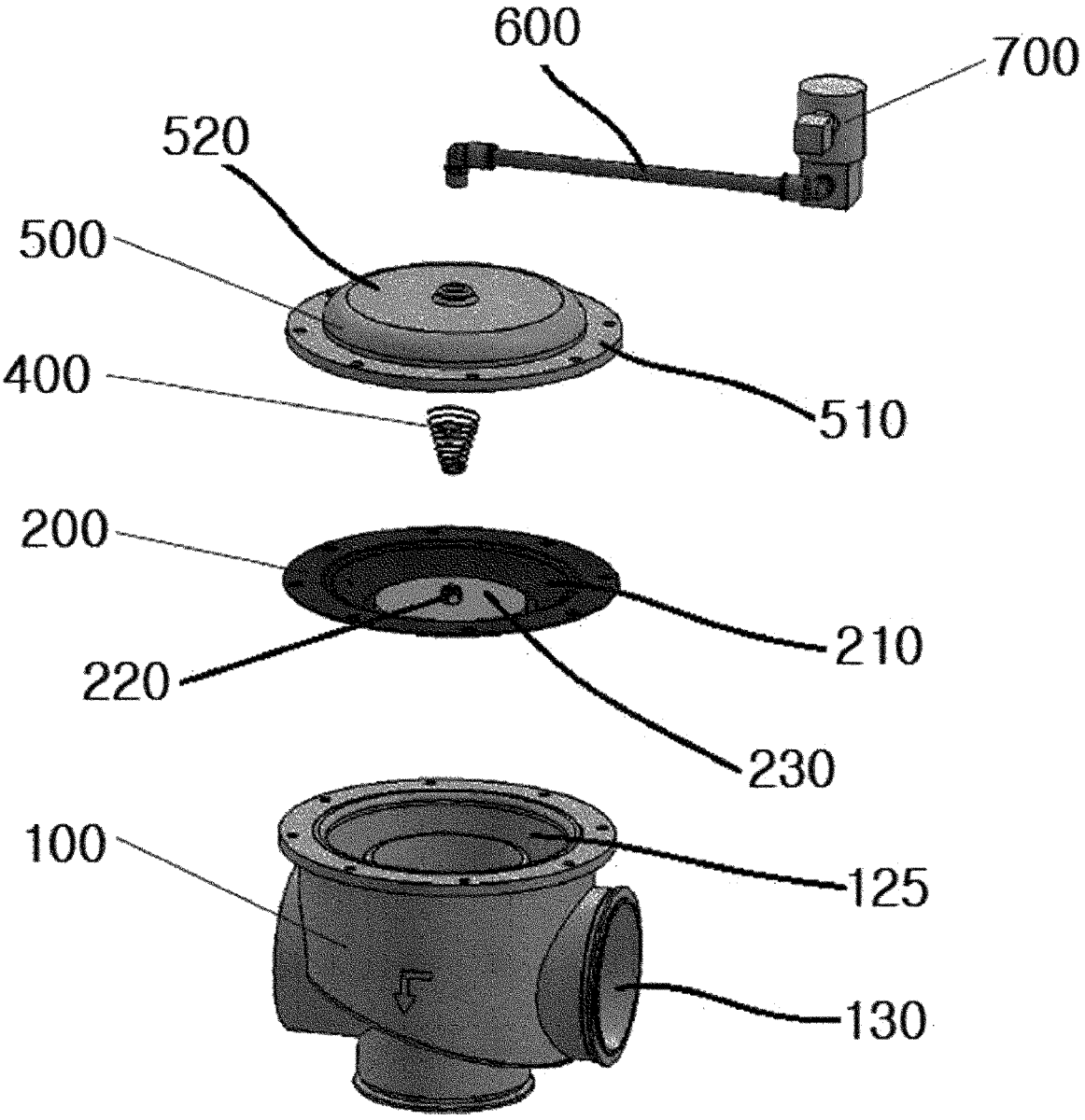
FIG. 3 is an exploded perspective view of the BOV valve using differential pressure of air according to an embodiment of the present invention.

FIG. 3 is an exploded perspective view of the BOV valve using differential pressure of air according to an embodiment of the present invention.

Figure 4:
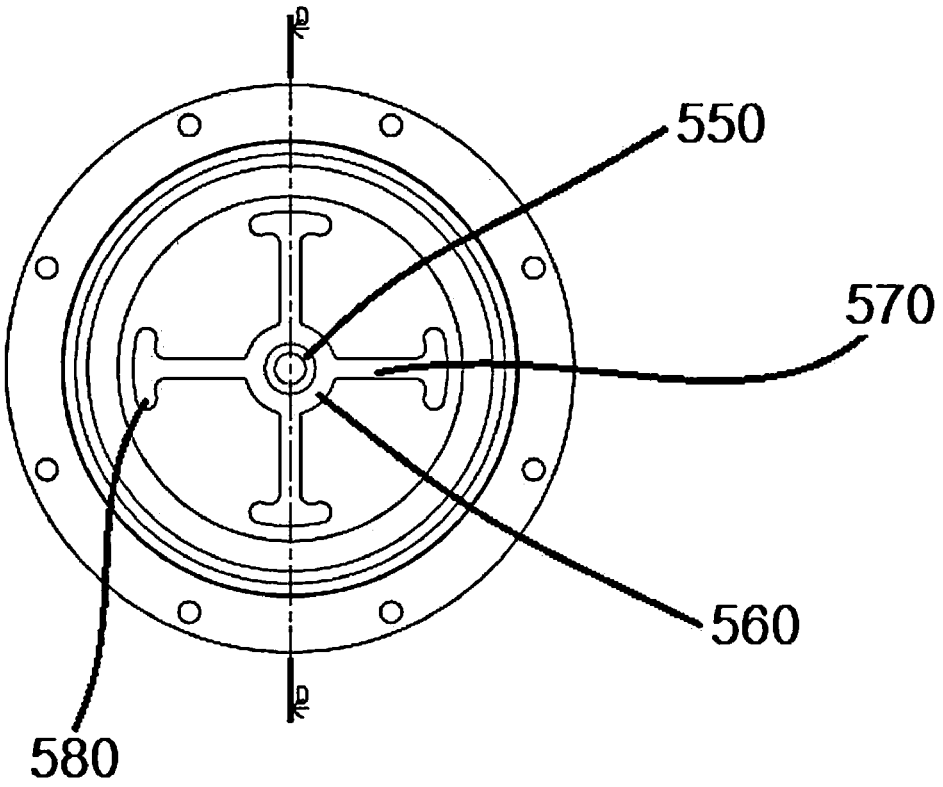
FIG. 4 is a plan view a BOV bonnet of the BOV valve using differential pressure of air according to an embodiment of the present invention.
Figure 5:
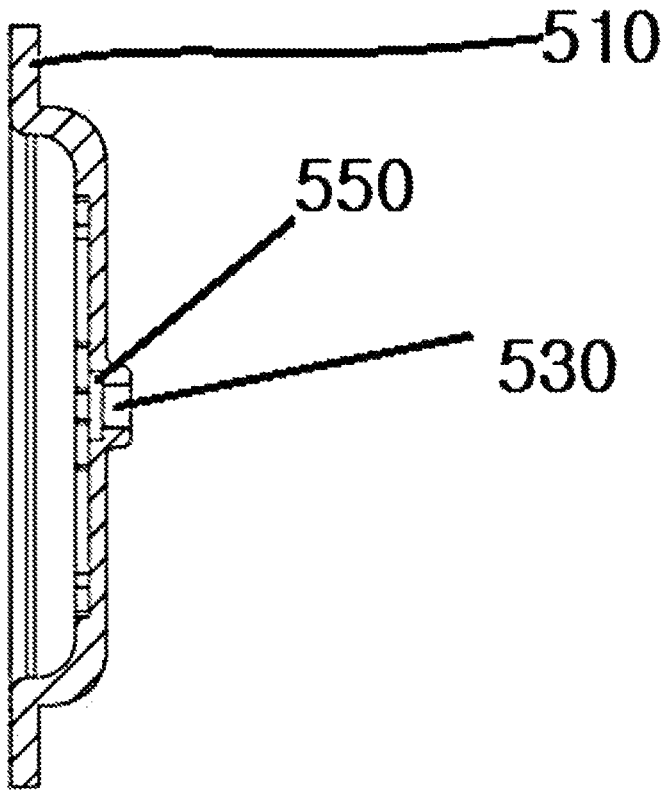
FIG. 5 is a cross-sectional view taken along line D-D.

FIG. 4 is a plan view a BOV bonnet of the BOV valve using differential pressure of air according to an embodiment of the present invention, and FIG. 5 is a cross-sectional view taken along line D-D.

Figure 6:
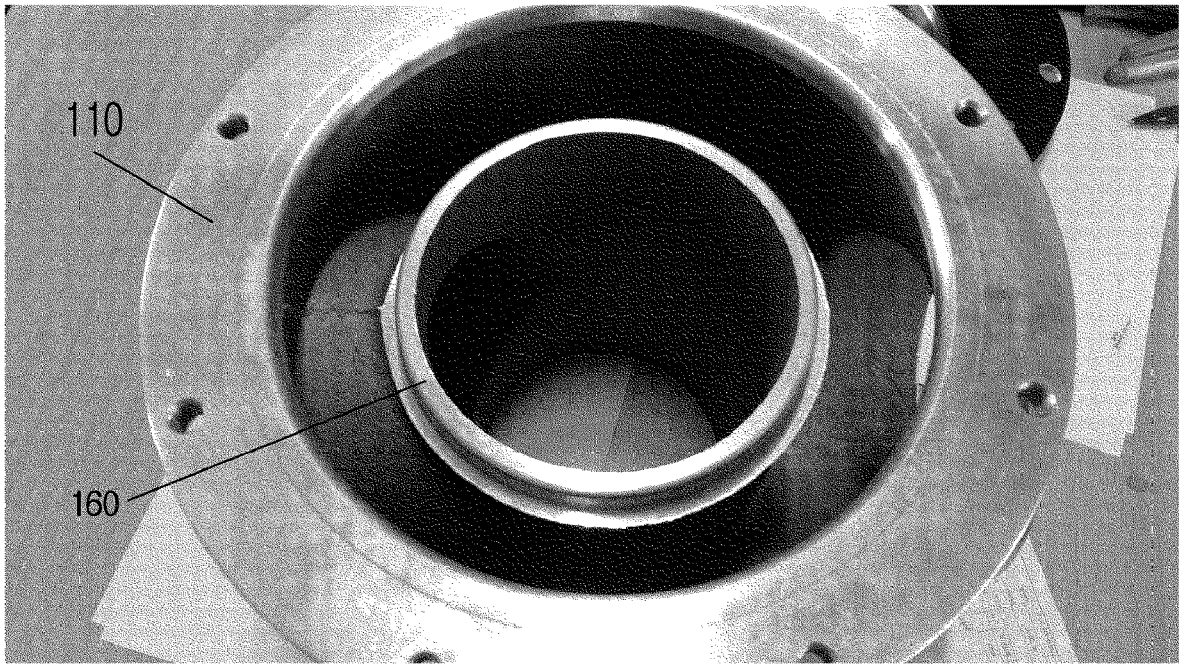
FIG. 6 is an exemplary view of a BOV base of the BOV valve using differential pressure of air according to an embodiment of the present invention.
Figure 7:
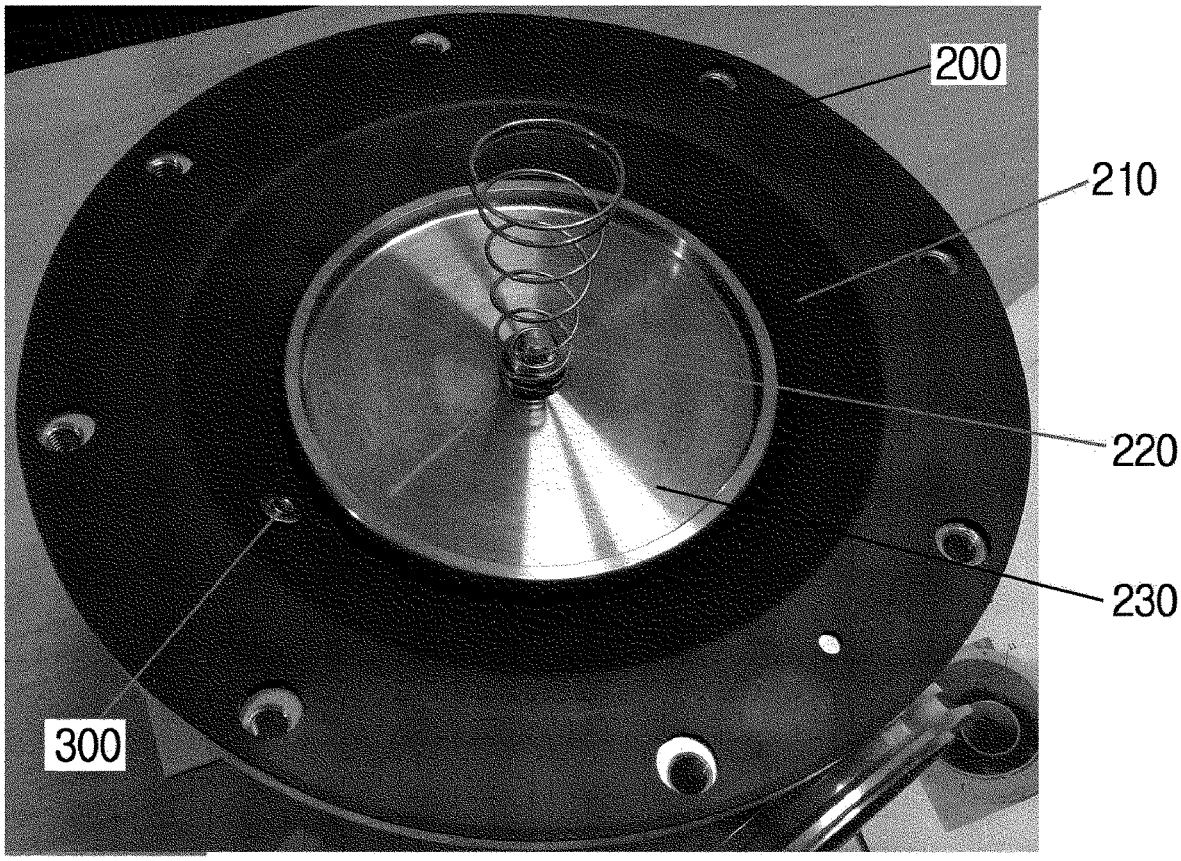
FIG. 7 is an exemplary view of a diaphragm, an air hole, and a spring.
Figure 8:
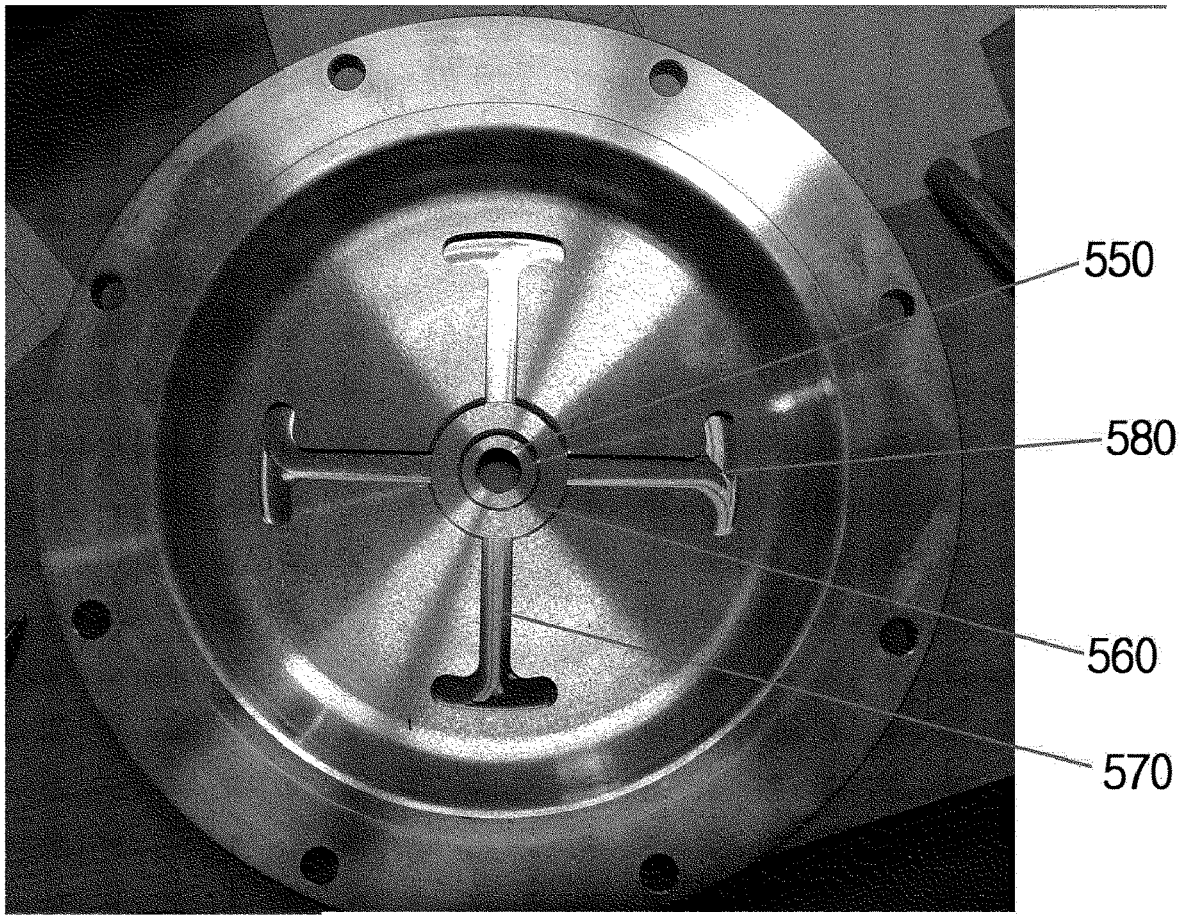
FIG. 8 is an exemplary view of air inflow induction grooves formed in the BOV bonnet.

FIG. 6 is an exemplary view of a BOV base of the BOV valve using differential pressure of air according to an embodiment of the present invention, FIG. 7 is an exemplary view of a diaphragm, an air hole, and a spring, and FIG. 8 is an exemplary view of air inflow induction grooves formed in the BOV bonnet.

FIG. 1 is a front view of a BOV valve using differential pressure of air according to an embodiment of the present invention, and FIG. 2 is a cross-sectional view taken along line C-C.

As shown in FIGS. 1 and 2, a BOV valve using differential pressure according to an embodiment of the present invention largely includes: a BOV base (100); a diaphragm (200); an air hole (300); a spring (400); a BOV bonnet (500); a pipe (600); and a solenoid valve (700).

The BOV base (100) has a flange (110) on the top and has an internal space.

The BOV base has a blowing port (130) connected with an outlet of a turbo blower and a discharge port (120) for discharging air flowing inside through the blowing port.

In detail, the BOV base (100) includes a hollow outer case (150) having the blowing port (130) at a portion of the outer surface.

The BOV base (100) further includes an inner case (160) disposed inside the outer case to form a space therebetween, extending from an end to the other end of the outer case, having the discharge port (120) at a side, and having an outlet (125) at the other side for supplying air to the discharge port.

That is, the blowing port (130) is formed at a portion of the outer surface of the outer case, and the inner case is disposed inside the outer case.

The inner case (160) is inside the outer case to form a space therebetween, extending from an end to the other end of the outer case, having the discharge port (120) at a side, and having an outlet (125) at the other side for discharging air to the discharge port.

The BOV base is formed by molding, which simplifies the manufacturing process and assembly process.

The diaphragm (200) is disposed with a side in contact with the flange of the BOV base.

The diaphragm (200) has a slope (210) inside and includes a spring-coupling plate (230) formed on a side of the slope and having a spring-coupling portion (220) at the center.

The operation of the BOV valve is described hereafter. When air flows into the blowing port (130), the air pushes up the diaphragm disposed at the top and is then discharged from the discharge port (120) through the outlet (125).

The air hole (300) is formed at a side of the slope of the diaphragm to function as an air channel.

For example, when the solenoid valve is closed, air is guided to air inflow expansion grooves (580) and air inflow induction grooves (570) to be described below through the air hole, thereby making the pressure over and under the diaphragm the same.

The spring (400) is coupled to the spring-coupling portion formed at the center of the diaphragm, and the diaphragm can be quickly moved down by the spring.

The top of the BOV base (100) is covered with the BOV bonnet (500).

To this end, the BOV bonnet (500) is disposed over the BOV base with the diaphragm therebetween.

Accordingly, the diaphragm should also be disposed between the flange, and a coupling hole is required to be fastened with fasteners.

In detail, the BOV bonnet (500) has: a bonnet flange (510) formed on the edge to be coupled to the flange of the BOV base; a bonnet protrusion (520) formed inside the bonnet flange and protruding upward such that the bottom is higher than the bottom of the bonnet flange; and a center hole (530) formed at the center of the bonnet protrusion.

Referring to FIG. 2, the bonnet protrusion (520) is formed inside the bonnet flange and protrudes upward such that the bottom is higher than the bottom of the bonnet flange.

That is, the bonnet protrusion is formed in a hat shape.

The pipe (600) has a first end coupled to the center hole and a second end coupled to the solenoid valve.

The solenoid valve (700) is coupled to the second end of the pipe.

According to another embodiment, a pressure sensor may be further provided to measure pressure so that the solenoid valve is operated on the basis of the measured pressure.

As for the operation process, air that is supplied through the blowing port (130) pushes up the diaphragm and the air supplied through the blowing port is discharged outside through the discharge port (120).

The air flowing inside is provided to the solenoid valve through the pipe, and when pressure exceeds predetermined pressure with the pressure sensor sensing whether the pressure exceeds the predetermined pressure, the solenoid valve is operated, thereby stopping air from flowing into the pipe.

Accordingly, air is guided to air inflow expansion grooves (580) and air inflow induction grooves (570) to be described below through the air hole, thereby making the pressure over and under the diaphragm the same.

In this process, the diaphragm moved up is quickly moved down by the spring.

According to another embodiment, the BOV valve (500) may further have: a first horizontal portion (550) formed under the center hole of the bonnet protrusion; a spring seat (560) formed under the first horizontal portion to be larger in diameter than the first horizontal portion in order to seat an end of the spring thereon; and the air inflow guide grooves (570) radially formed around the spring seat in the same horizontal plane as the spring seat in a form of a continuous groove such that air flows into the spring seat from the outside of the grooves.

That is, referring to FIGS. 2, 4, and 5, the first horizontal portion (550) is formed under the center hole of the bonnet protrusion.

The spring seat (560) is formed under the first horizontal portion to be larger in diameter than the first horizontal portion in order to seat an end of the spring thereon.

According to another embodiment, the air inflow induction grooves (570) may be radially formed around the spring seat.

That is, the air inflow induction grooves are formed around the spring seat in the same horizontal plane as the spring seat in the form of a continuous groove such that air flows into the spring seat from the outside of the groove.

According to another embodiment, the air induction expansion grooves (580) are formed at the ends of the air inflow induction grooves to expand in a form of continuous groove in the same horizontal plane at angles different from the ends of the air inflow induction grooves.

The air inflow expansion grooves and air inflow induction grooves are formed in plurality.

Further, as shown in the figures, the air inflow expansion grooves and air inflow induction grooves are preferably formed perpendicular to each other.

In more detail, when air flows between the diaphragm and the bonnet flange (500) through the air hole (300), the air flows inside in all direction through the air inflow expansion grooves (580) and concentrates to the center hole through the air inflow induction grooves (570), so the diaphragm is moved away from the bonnet flange, and in this process, the diaphragm is additionally pushed by the spring.

That is, when the diaphragm is moved down by the air concentrating to the center, it is quickly moved with the spring, so the BOV valve is closed.

In summary, the operation of the spring gets faster when the entire pressure changes from the atmospheric pressure to the same pressure, so the BOV valve is quickly closed.

For example, when the diameter of the diaphragm is 50 A (mm), it does not relate to the closing speed, but when the diameter of the diaphragm is 150 A or more, a severe problem of reduction of the performance of the BOV valve using differential pressure of air occurs if the closing speed is low.

Accordingly, the groove passages are formed in all directions to quickly operate the BOV valve when the diameter is 150 A or more, thereby achieving instant operation.

The BOV valve employs the method of operating the diaphragm using differential pressure, that is, as described above, a plurality of air inflow expansion grooves (580) and air inflow induction grooves (570) are formed, thereby controlling the movement speed of the diaphragm. As shown in Table 1, the larger the cross-section of the grooves, the higher response speed can be achieved.

TABLE 1

| Number of articles | Closing speed | Cross-sectional area of diaphragm (mm) |
|---|---|---|
| One air inflow expansion groove and one air inflow induction groove | 20 sec. | 50 |
| Four air inflow expansion grooves and four air inflow induction grooves | 2 sec. | 150 |
| Six air inflow expansion grooves and six air inflow induction grooves | 1 sec. | 200 |
| Eight air inflow expansion grooves and eight air inflow induction grooves | 0.4 sec. | 250 |

That is, it is possible to provide a higher response speed by increasing the cross-sectional area of the grooves (the number of the grooves) in proportion to the size of the diaphragm.

According to the above configuration and operation of the present invention, the BOV valve that is operated using differential pressure of air can be accurately operated and includes the BOV base manufactured by molding, so the manufacturing process and assembly process can be simplified.

Further, it is possible to increase the response speed of the diaphragm by forming the plurality of air inflow expansion grooves and the air inflow induction grooves in the BOV bonnet.

While the present invention has been described with respect to the specific embodiments, it will be apparent to those skilled in the art that various changes and modifications may be made without departing from the spirit and scope of the present invention as defined in the following claims.

INDUSTRIAL APPLICABILITY

The present invention provides a BOV valve that is operated using differential pressure of air and can be accurately operated. Further, a BOV base manufactured by molding is provided, so the manufacturing process and assembly process can be simplified, so the BOV valve can be useful in the field of a turbo blower.

What is claimed is:

1. A blow-off valve (BOV) using differential pressure of air, the BOV comprising:

a BOV base (100) having a flange (110) on the top, having an internal space, having a blowing port (130) connected with an outlet of a turbo blower, and having a discharge port (120) for discharging air flowing inside through the blowing port;

a diaphragm (200) having a side being in contact with the flange, having a slope (210) inside, including a spring-coupling plate (230) formed on a side of the slope, and having a spring-coupling portion (220) at the center;

an air hole (300) formed at a side of the slope of the diaphragm to function as an air channel;

a spring (400) coupled to a spring-coupling portion formed at the center of the diaphragm;

a BOV bonnet (500) having a bonnet flange (510) formed on the edge to be coupled to the flange of the BOV base with the diaphragm therebetween, a bonnet protrusion (520) formed inside the bonnet flange and protruding upward such that the bottom is higher than the bottom of the bonnet flange, a center hole (530) formed at the center of the bonnet protrusion, a horizontal portion (550) formed under the center hole of the bonnet protrusion, a spring seat (560) formed under the horizontal portion to be larger in diameter than the horizontal portion in order to seat an end of the spring thereon, a plurality of air inflow guide grooves (570) radially formed around the spring seat in the same horizontal plane as the spring seat in a form of a continuous groove such that air flows into the spring seat from an outside of the grooves, and a plurality of air induction expansion grooves (580) formed at ends of the plurality of air inflow induction grooves to expand in a form of continuous groove in the same horizontal plane at angles different from the ends of the plurality of air inflow induction grooves;

a pipe (600) having a first end coupled to the center hole and a second end coupled to a solenoid valve; and a solenoid valve (700) coupled to the pipe.

* * * * *